US005894812A

United States Patent [19]

Dessingue

[11] Patent Number: 5,894,812

[45] Date of Patent: Apr. 20, 1999

[54] BOAT HOOD

[76] Inventor: John Dessingue, 1 -103rd. St., Troy, N.Y. 12180

[21] Appl. No.: 08/972,987

[22] Filed: Nov. 19, 1997

[51] Int. Cl.[6] ..... B63B 17/00

[52] U.S. Cl. ..... 114/361; 114/364

[58] Field of Search ..... 114/343, 361, 114/364; D12/317

[56] References Cited

U.S. PATENT DOCUMENTS

| | | | |
|---|---|---|---|
| D. 348,647 | 7/1994 | Hull . | |
| 2,864,391 | 12/1958 | Stark | 114/361 |
| 3,698,409 | 10/1972 | Koontz et al. . | |
| 4,922,849 | 5/1990 | Wills | 114/361 |
| 5,662,062 | 9/1997 | Veverka | 114/361 |

*Primary Examiner*—Ed L. Swinehart

[57] ABSTRACT

An item of manufacture to cover the bow of a boat to provide additional stowage space and protection from oncoming and overhead elements having a main body (11) of a rigid material with side portions rising from both sides of the outer edges of the bow, and a top portion spanning the side portions. Latch hasps (25) are mounted to the bottom edge of the main body near the front and back area on both sides. "U" channels (21) of a rigid material, with a channel width to accept the bottom edge of the main body are mounted to the outer edges of the bow using screws. On the outside edges of the channels, latch nubs (27) are mounted near the front and rear, positioned to couple with the latch hasps mounted on the main body. Seals (23) of a flexible material are inserted into the channels. The main body is attached to the bow by seating the bottom edges of the main body into the channels with the latch hasps and nubs aligned, and coupling or latching the latches. To remove, the latches are uncoupled and the main body is lifted of the bow. On the main body is installed a hatch (31) with a pair of hinges (37) on one side, to open and close the hatch, and a pair of latch sets (35) on the opposite side to secure the hatch closed.

1 Claim, 4 Drawing Sheets

BOAT HOOD

BACKGROUND-FIELD OF INVENTION

This invention relates to boats, specifically a new item of manufacture that attaches to the bow of a boat.

BACKGROUND-DESCRIPTION OF PRIOR ART

Recreational boaters are faced with the problems of storage space (stowage), both when docked and during operation, and protection from elements in open bow boats, for both passengers and the bow deck itself On closed bow boats (boats with a bow deck such as a cuddy cabin type boat), the bow deck area is occasionally used to stow items such as inflatable tubes or rafts for recreational use, extra life vests, supplies in canvas bags or other soft items. One method of securing these items to the bow deck is by "lashing down" the items, or tying them down with ropes attached to the boat's cleats or bow rails. This method is less than ideal. Some problems associated with it are:

- items are exposed to weather elements from above and oncoming wind and spray when the boat is in use;
- items can "flap around" in the wind when not properly lashed down;
- parts of the stowed items such as straps, handles, belts and clips flap in the wind even when the items are lashed properly;
- the wind and vibration on an operating boat can loosen the ropes that secure the items.

Previously, attachments for the front, or bow of a boat were designed for below deck (boat interior) access or as a windguard or splashguard. Stowage and true protection from a range of natural elements were not addressed. Securing or mounting of these attachments are clumsy and time consuming.

One type of boat cover, U.S. Pat. No. 4,922,849 to Wills (1990) discloses a cover to an open passageway to the lower interior of a boat; however, it is designed to cover only the passageway on an open bow boat and only provides a hatch, or doorway for access. On a fully open bow boat (such as a recreational type bow rider), once passengers are seated in the bow, the Wills invention would provide very little "head room" for the passengers. Also, its means of securing involves threaded hooks that must be manipulated with nuts each time it is attached or removed.

U.S. Pat. No. D348,647 to Hull (1994) discloses a removable boat bow riser that functions as a windguard, splashguard or bug shield, similar to the shields attached to the front hoods of trucks; however, it does not provide protection from elements other than some wind and spray and it does not provide any additional means of stowage, or storage space. Weather elements from above are not addressed. This, also, is inconvenient to attach and remove, securing to rails with threaded clamps.

U.S. Pat. No. 3,698,409 to Koontz (1972) discloses a framed canopy cover that functions as a temporary, lightweight area for interior comfort while docked; however, it must be disassembled to operate the boat and additional stowage for the disassembled unit is necessary during operation and prolonged dockage.

My invention is made to provide space and protection from the elements for stowage, passengers and bow deck with one attachment, is easy to access and attachment to the bow is simple, accomplished with latches; without the need to manipulate nuts or clamps.

Some of the disadvantages of previous inventions are:

(a) protection from weather elements is limited- a device to protect the interior area of a boat does not provide protection from oncoming elements for the bow deck or items stowed there; a device at the bow provides only limited protection to bow areas and no protection for interior areas;

(b) protection of the interior, the bow deck area, items stowed and prow (very front) of the boat can be accomplished at the same time only by using these inventions in conjunction, or two or more different devices;

(c) the attachment (mounting) is difficult and time consuming.

OBJECTS AND ADVANTAGES

The objects and advantages of the present invention are:

(a) to provide a boat hood for a cuddy (closed front boat) that provides additional stowage, or storage space, for use while docked or operating;

(b) to provide a boat hood to provide protection from the elements to items being stowed;

(c) to provide a boat hood for a bow rider (open front seating boat) for protection from the elements, additional stowage and privacy;

(d) to provide a boat hood which can be easily removed and secured, is durable, is lightweight and is weather resistant;

(e) to provide a boat hood which can be any color, clear or opaque and decorated.

Further objects and advantages are to provide a boat hood which is simple to use and inexpensive to manufacture. Still further objects and advantages will become apparent from a consideration of the ensuing description and drawings.

DRAWING FIGURES

In the drawings, each part has the same reference number throughout the figures.

REFERENCE NUMERALS

10. Boat Hood
11. Main Body
21. "U" Channels
23. Seals
25. Latch Hasps
27. Latch Nubs
31. Hatch
35. Hatch Latches
37. Hatch Hinges
50. Air-filled Tube (phantom lines)
60. Passenger (phantom lines)

Description-FIGS. 1 through 4

Figure 1:
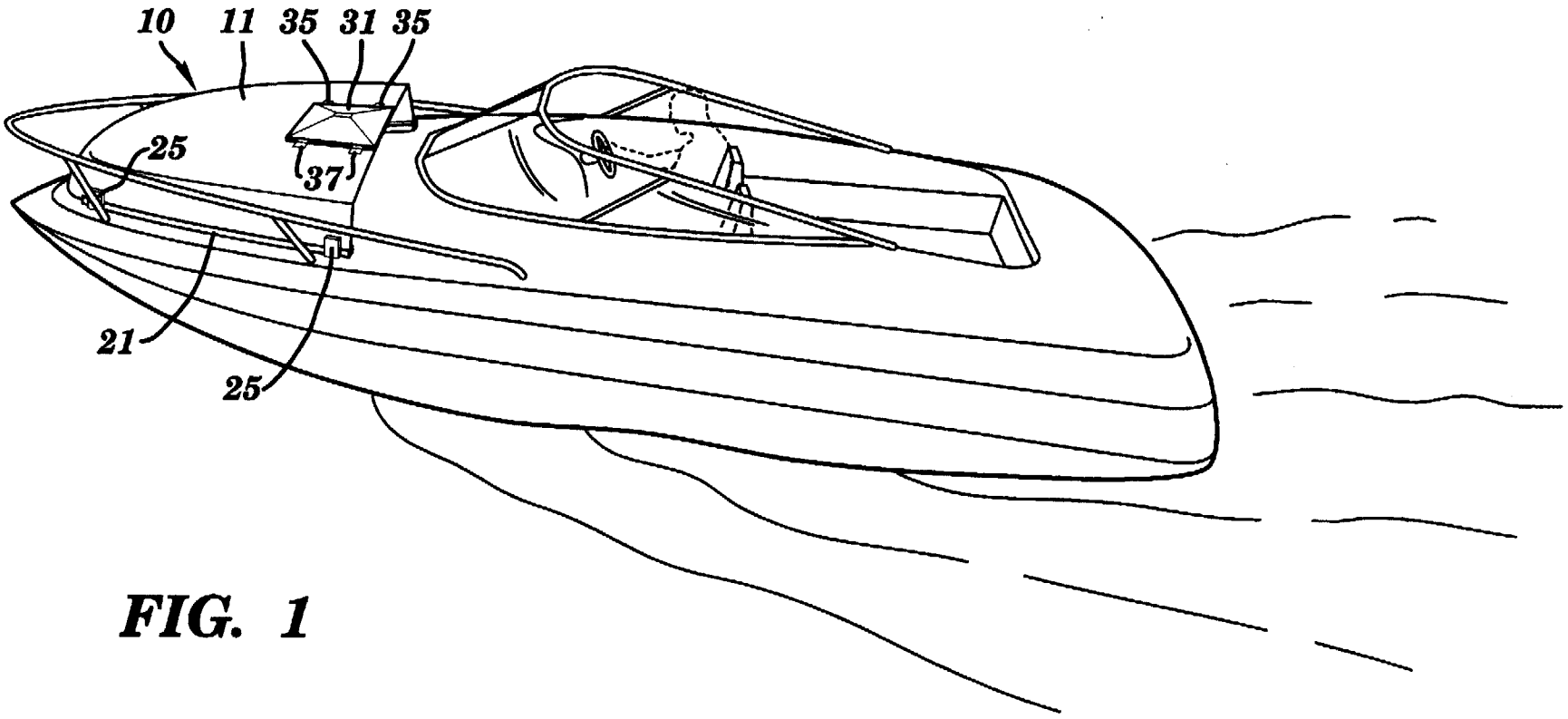
FIG. 1 shows a boat hood, with a secured hatch, secured to a cuddy cabin type boat.
Figure 2:
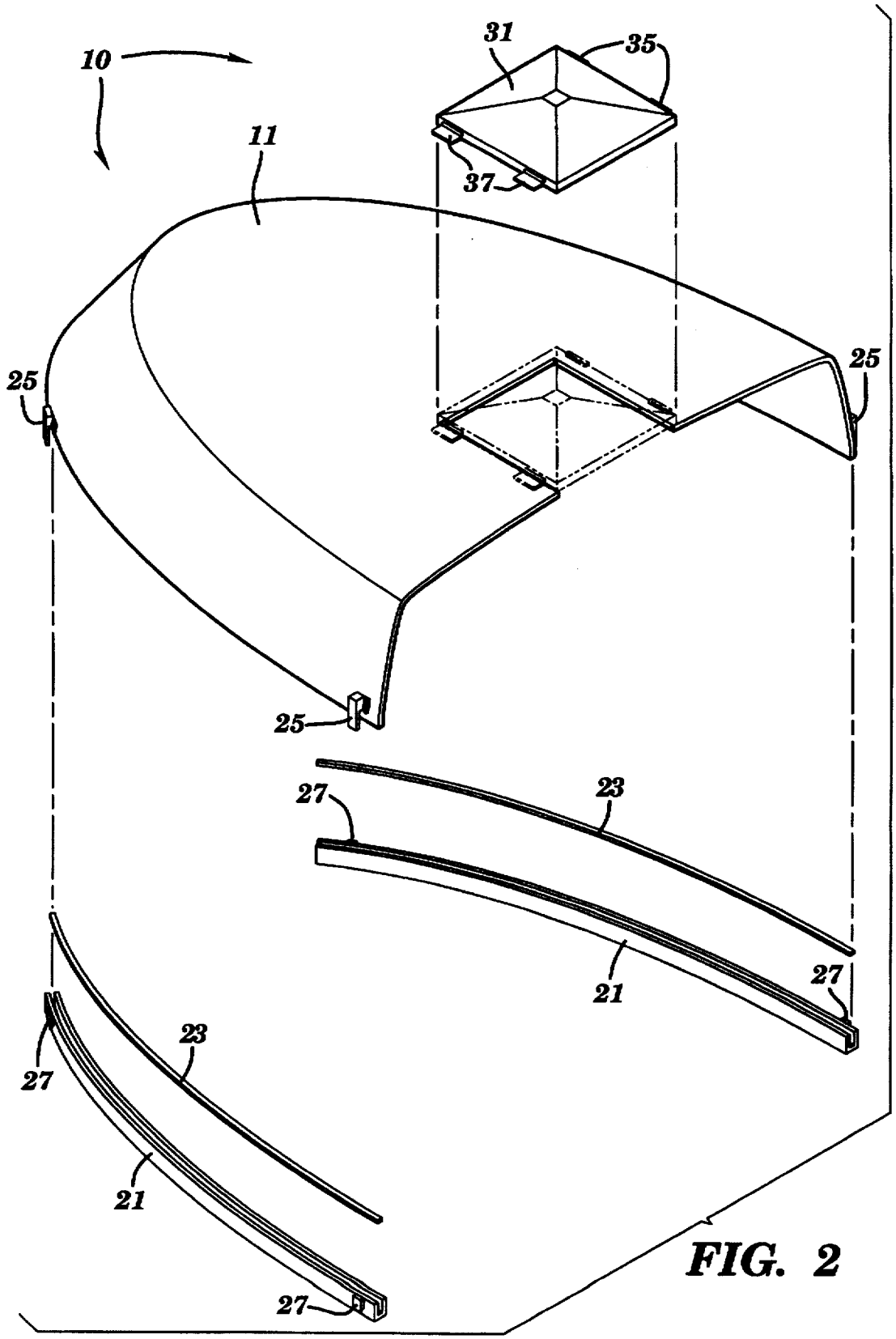
FIG. 2 shows an "exploded" aspect of the same hood exposing mounting apparatus.

In FIG. 1 a typical embodiment of the presently invented boat hood 10 is illustrated, mounted to a boat in operation. An exploded view of the boat hood is shown in FIG. 2. The hood is comprised of a main body 11 of a uniform cross-section consisting of a rigid fabricated plastic material which can resist wear and cracking when exposed to the elements. The sides of the main body are formed so that when attached to a boat they rise from near the outer edge of the boat's bow deck, while the top area spans the sides.

In this preferred embodiment, the main body is molded acrylic sheet (Plexi-glass®), however, the main body may consist of any rigid or semi-rigid material including, but not limited to PVC, polyolefin glass, glass fabric, fiberglass, metal, composites, wood, coated wood or rubber.

Latch Hasps 25 (the hinged or moveable part) of standard case latches are mounted to the main body near the bottom edge. In this embodiment, four sets of latches are used: two on each side, one near the fore, one near the aft, of the boat hood. Mounting is achieved using a resinous epoxy, however, any means of mounting (i.e. bolts, machine screws, other adhesives) is acceptable if desired results are produced. The relative position of mounting hasps to main body can be seen in FIG. 3 (overhead view) and FIG. 4 (side view).

Figure 3:
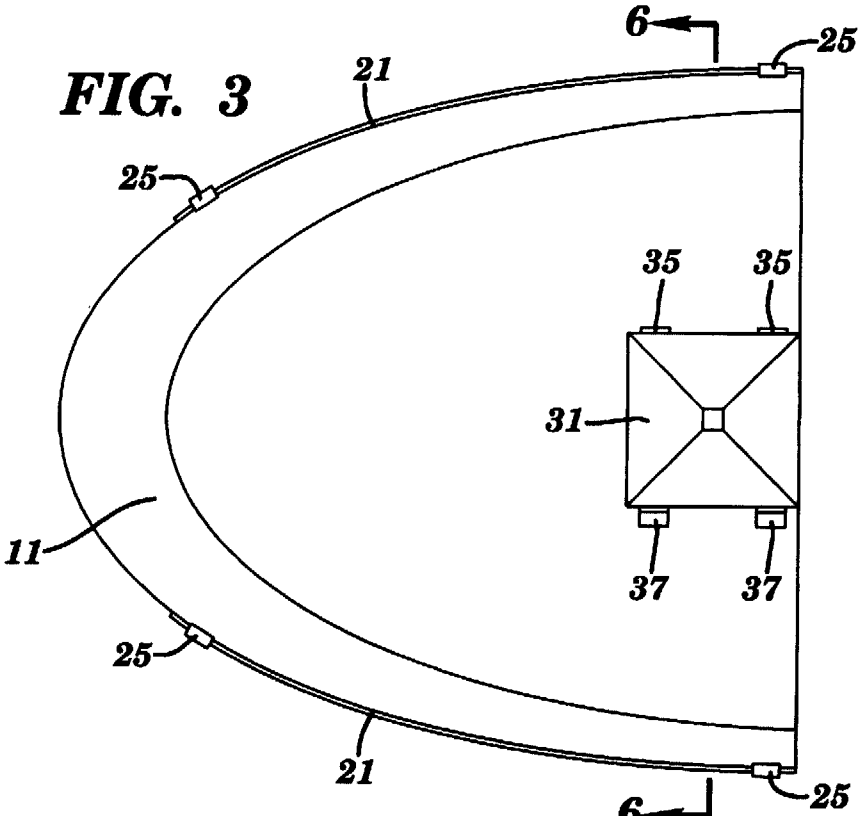
FIGS. 3 and 4 show overhead and lateral views of the boat hood, respectively.
Figure 4:
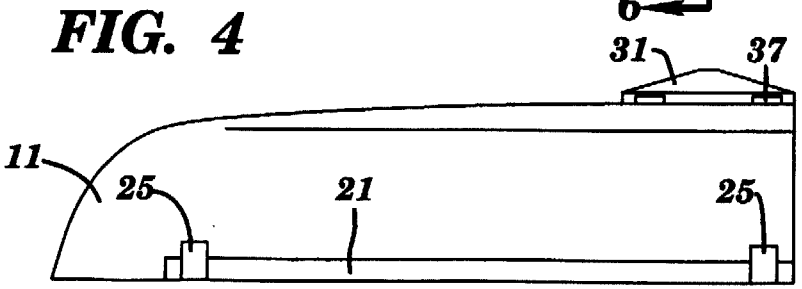

To the bow deck of the boat, near the outside edges of the bow, "U" channels 21 are mounted to the deck, inside the area of the bow deck supporting boat cleats and bow rails (typically 1" to 3" from the outer edge of the bow). The channels are curved to match the outline of the bottom edge of the main body and have channel grooves facing upward. The widths of the grooves in the channels correspond to the thickness of the main body of the boat hood. The channels are comprised of aluminum, but any rigid material, such as other metals, plastic or composites will produce the desired results. The channels are mounted using screws (not shown) through pilot holes in the channels and sunk into the bow deck material. Again, this method represents but one means of mounting, which may also be accomplished using a glue or epoxy, or by manufacture of the bow deck incorporating these channels. The channels are mounted in position to accept the bottom edge of the main body into the channels' grooves. Seals 23 are inserted into the channels. The purpose of these seals is to reduce transmission of vibration from boat to boat hood while the boat is in operation and to reduce or eliminate water leakage. In this embodiment the seals are comprised of silicone, but any flexible, "rubber-like" material may be used. The seals are the same length as the channels and are uniform in cross section, with a width slightly larger than the width of the grooves in the channels. The seals are pressed into the grooves and are held in place by friction. In other embodiments where the matter of transmission of vibration and water leakage is addressed by other means, these seals may possibly be omitted. FIGS. 3 and 4 show the curvature and profile of the channels and seals.

Mounted to the channels, on the outside edge, and in position corresponding to the position of the latch hasps, are the latch nubs 27 (the non-moving part of the case latch to which the latch hasps attach). In the preferred embodiment, the nubs are mounted to the channels using epoxy, but, once again, the means of mounting is limited only by performance and the latch nubs may even be incorporated into the fabrication of the "U" channels.

In addition the to main body and mounting and attachment apparatus discussed here, this embodiment includes a hatch 31, useful to better access interior portions of the boat hood, and to allow space for operating (opening and closing) a hatch that may be installed on the bow deck. The hatch on the bow hood is not essential to the functioning of the bow hood, but may be convenient in many instances. The hatch is comprised of the same material as the main body, and is convex, or slightly raised in the center. The hatch is mounted to the main body, near the rear, by means of standard hinges 37 on one side and secured by standard case latches 35 on the other side. The position of the hatch, and its hinges and latches, is shown in FIGS. 3 and 4. Means of mounting hinges and latches both to the hatch and the main body is epoxy in this embodiment. However, once again, any suitable means is acceptable.

From the preceding description, many advantages of my boat hood become clear:

(a) protection from the elements for items stowed on a cuddy cabin boat is achieved. Items need not be lashed across the bow, rail to rail, as they can be safely stowed in the boat hood. They will not "flap around" from oncoming wind, are protected from oncoming wind and elements and are protected from elements overhead;

(b) passengers seated in the bow of a bow rider are protected from oncoming and overhead elements as well;

(c) the boat hood may afford additional protection from some oncoming elements (wind and spray) even for the driver of the boat and passengers on the middeck and in the stern (rear) of the boat;

(d) the hood is lightweight and can be clear, translucent or opaque, and can be decorated in many ways;

(e) the shape of the hood lends a more aerodynamic contour to the bow of a boat than does a flat bow boat.

Operations-FIGS. 5 through 8

Figure 5:
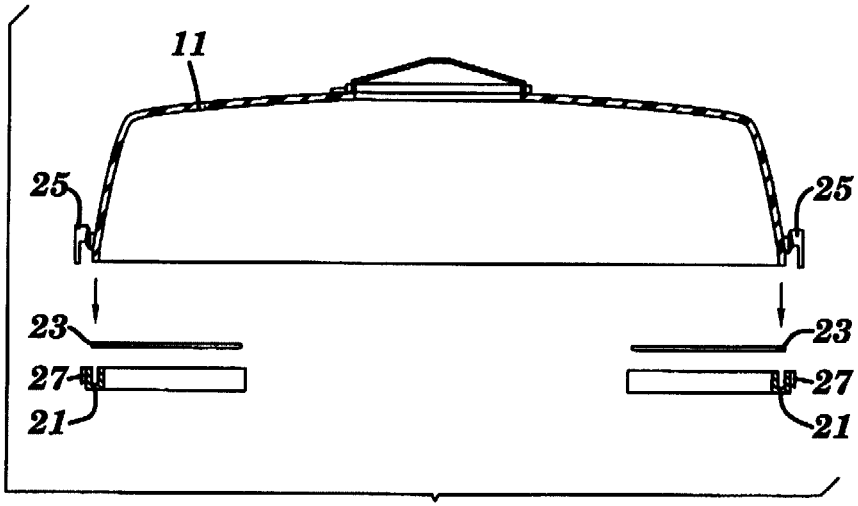
FIG. 5 shows a cutaway rear view of attachment of a boat hood and mounting apparatus (at cross section aspect 5 from FIG. 3).
Figure 6:
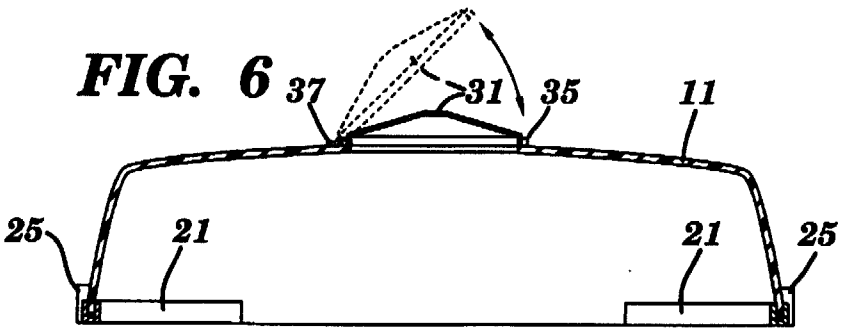
FIG. 6 shows a cutaway rear view of a secured boat hood, depicting operation of a hinged hatch.

Operation of the boat hood is depicted in FIG. 5, a cutaway rear view (at cross section aspect 5 from FIG. 3). Once the channels 21 are mounted to the bow and the seals 23 are inserted into the channel, the bottom edge of the main body 1 is seated into the channels, positioned so that the latch hasps 25 are directly above the latch nubs 27. The hasps are latched to the nubs and by doing so the boat hood is attached to the boat's bow. To remove the hood from the boat, the operation is reversed. The hasps are unlatched from the nubs and the hood is lifted off the boat. FIG. 6 (also cross section aspect 5 from FIG. 3) show the hood secured to the boat with the bottom edge seated in the channels and latches engaged (latched).

FIG. 6 also shows the operation of the hatch 31 on the hood. To open, the hatch latches 37 are disengaged and the hatch is swung open, moving on hinges 35 mounted on the main body. To close the hatch, the operation is reversed by swinging closed the hatch and engaging the latches.

Figure 7:
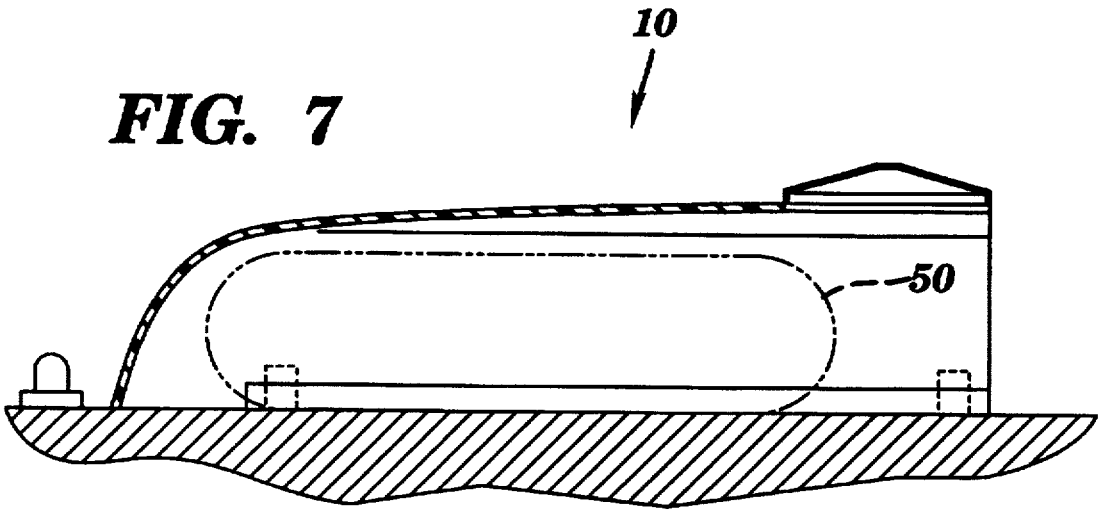
FIGS. 7 and 8 show cutaway lateral views of secured boat hoods; phantom lines depict stowage on a cuddy cabin and seating on a bow rider, respectively.
Figure 8:
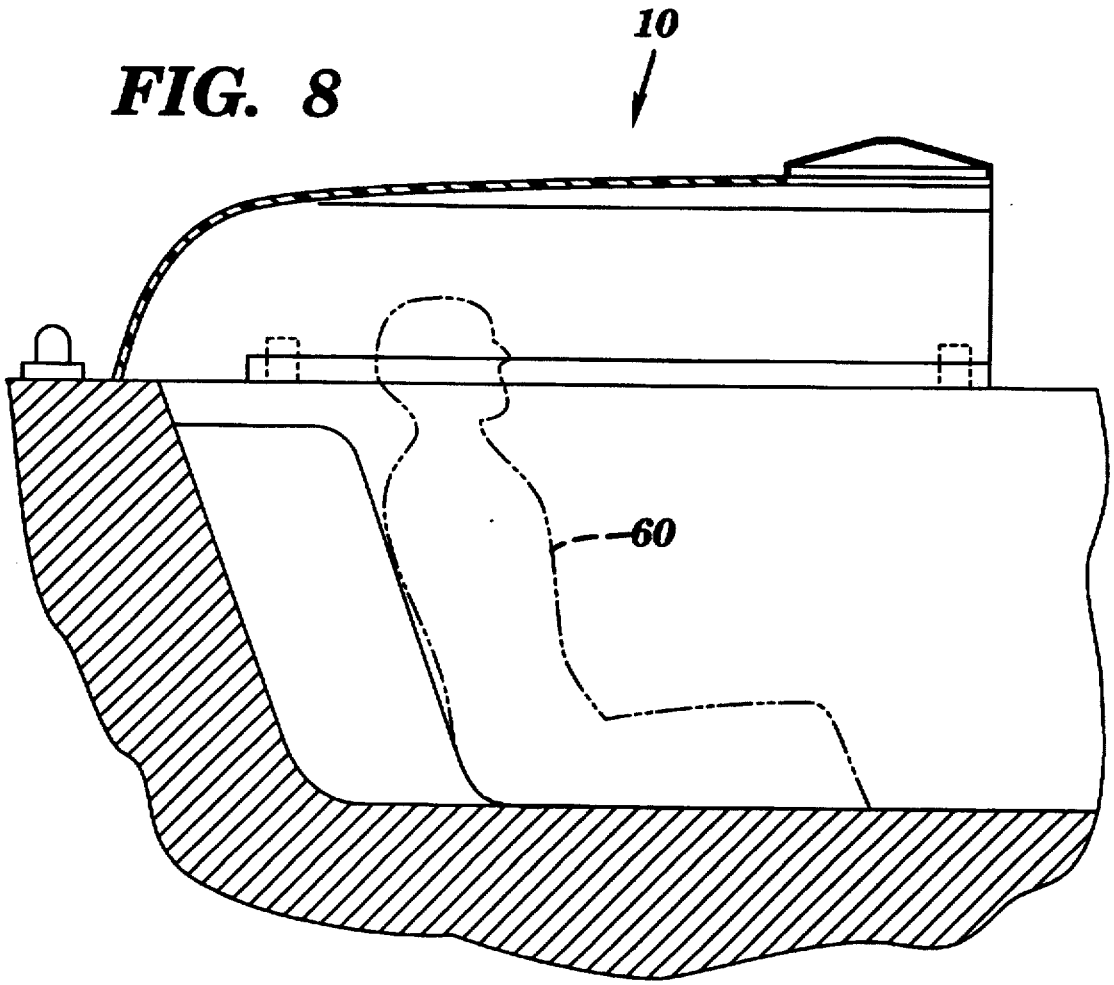

Use of the boat hood is depicted in FIGS. 7 and 8 (both are side view cross sections). In FIG. 7, an air-filled tube 50 (phantom lines), used by recreational boaters for towing people, is shown stowed under a boat hood attached to the bow deck of a boat. FIG. 8 shows the same boat hood attached to a bow rider type boat, with a passenger 60 (phantom lines) seated in the bow, under the boat hood which provides protection from the elements for him.

Summary, Ramifications and Scope

The reader can see that use of the boat hood provides protection from the elements for both stowed items and passengers. The hood is very easy to use and attachment to the boat is simple. It can be made in a variety of sizes to fit any boat, and can be colored, designed and decorated in many ways. In addition to these advantages, the boat hood can:

provide oncoming and overhead protection, eliminating the need for multiple devices for this purpose;

permit manufacture for color matching or contrasting with the boat to which it attaches;

lend an aerodynamic, stylish profile to the bow of a boat;

be comprised of a variety of materials.

Although the description of the boat hood contains many details, this does not limit the scope of this invention but merely gives one example of a boat hood, the presently preferred embodiment. To cite some other examples of the invention, embodiments include:

means of attachment such as clips, clamps, hooks, screws or bolts. Attachment may be accomplished by the manufacture of channels incorporated into the bow, or the entire hood manufactured incorporated into the bow;

location of attachment to the bow rails, outside the bow rails on a day cruiser (low railed type of boat), or to the gunnel (area of hull just below the outside edges of the bow deck);

no hatch included in the design, different location of the hatch or multiple hatches;

hinges at the bow, rear, or either side of the hood, attaching to the bow, or hinges on both sides with a "split" hood closing at center;

cutouts for access to rails and cleats or manufacture including molded handles and cleats;

a rear door to entirely enclose the hood, or a design to extend the hood to the windshield;

a channel and seal extending the entire circumference of the bottom edge of the hood for a watertight area below;

compartmentalized design allowing for shelves or "cubby-holes";

stylizing the design and contour of the hood;

a modular design and construction, such as interlocking panels, or panels secured to a frame for use on large boats, especially on boats large enough for standing space on the bow deck, for an "atrium" effect;

reinforcement of the hood using mesh, bars or molded ribs manufactured in the hood, or any reinforcing means.

Therefore, from the preceding list of ramifications, the scope of this invention should be determined not by the example of the main embodiment given, but rather by the appended claims and their legal equivalents.

I claim:

1. A rigid hood for attachment on the bow of a boat, said boat including a generally contiuous from port to starboard bow deck, said rigid hood comprising:

a) a generally flat and horizontally disposed top portion for spanning above said bow deck, b) side portions extending downwards from said top portion on port and starboard sides thereof, and being adapted to rest upon said bow deck, c) means for connecting said side portions to said bow deck of said boat, whereby, when said rigid hood is placed upon said bow deck, a storage space is defined by said top portion, said side portions and said bow deck, said space being protected from the elements by said top and side portions.

* * * * *